US009124975B2

(12) United States Patent
Andersen

(10) Patent No.: US 9,124,975 B2
(45) Date of Patent: Sep. 1, 2015

(54) HEADSET DEVICE WITH FITTING MEMORY

(71) Applicant: Michael Hoby Andersen, Copenhagen (DK)

(72) Inventor: Michael Hoby Andersen, Copenhagen (DK)

(73) Assignee: GN Netcom A/S (DK)

( * ) Notice: Subject to any disclaimer, the term of this patent is extended or adjusted under 35 U.S.C. 154(b) by 27 days.

(21) Appl. No.: 13/929,092

(22) Filed: Jun. 27, 2013

(65) Prior Publication Data

US 2014/0003646 A1 Jan. 2, 2014

(30) Foreign Application Priority Data

Jun. 29, 2012 (EP) ..... 12174384

(51) Int. Cl.
*H04R 9/08* (2006.01)
*H04R 1/10* (2006.01)
*H04R 1/08* (2006.01)

(52) U.S. Cl.
CPC ..... *H04R 1/105* (2013.01); *H04R 1/08* (2013.01); *H04R 2201/107* (2013.01); *H04R 2201/109* (2013.01)

(58) Field of Classification Search
CPC .. H04R 1/1066; H04R 1/1041; H04R 5/0335; H04R 1/08; H04R 2201/107; H04R 2201/109
USPC ..... 381/367, 375, 369
See application file for complete search history.

(56) References Cited

U.S. PATENT DOCUMENTS

| | | | | | |
|---|---|---|---|---|---|
| 2,428,746 | A * | 10/1947 | Veneklasen | 379/430 |
| 3,190,974 | A * | 6/1965 | Vasicek | 381/375 |
| 6,016,347 | A * | 1/2000 | Magnasco et al. | 379/430 |
| 6,101,260 | A * | 8/2000 | Jensen et al. | 381/381 |
| 7,082,393 | B2 * | 7/2006 | Lahr | 704/233 |
| 8,204,267 | B2 * | 6/2012 | Leske et al. | 381/374 |
| 8,290,194 | B2 * | 10/2012 | Kuo | 381/375 |
| 8,331,603 | B2 * | 12/2012 | Martenson et al. | 381/379 |
| 8,565,468 | B2 * | 10/2013 | Ito et al. | 381/378 |
| 8,675,885 | B2 * | 3/2014 | Sapiejewski | 381/71.6 |
| 8,818,461 | B2 * | 8/2014 | Cybart et al. | 455/569.1 |
| 2002/0131616 | A1 * | 9/2002 | Bronnikov et al. | 381/370 |
| 2006/0140435 | A1 * | 6/2006 | Sheehy et al. | 381/390 |
| 2010/0158264 | A1 * | 6/2010 | Marten | 381/74 |
| 2011/0228925 | A1 * | 9/2011 | Birch | 379/428.02 |
| 2012/0020491 | A1 * | 1/2012 | Dory | 381/74 |
| 2012/0099738 | A1 * | 4/2012 | Lee et al. | 381/74 |

* cited by examiner

*Primary Examiner* — Curtis Kuntz
*Assistant Examiner* — Ryan Robinson
(74) *Attorney, Agent, or Firm* — Altera Law Group, LLC

(57) ABSTRACT

A headset device (1) comprising an attachment device (2) for attaching the headset device (1) to the head (3) of a user. The headset device (1) also comprises an audio device (4, 6) for transducing audio to an electrical signal or vice versa and adjustment means (7, 8) for adjusting the mutual positions and/or orientations of the attachment device (2) and the audio device to (4, 6) to a user-specific position, in which the headset device (1) is adjusted to the geometry of the users head (3). The adjustment means (7, 8) comprises selecting means (9; 10; 20; 41) for storing a first user-specific position, whereby a user quickly can readjust the headset device (1) from a non-user-specific position or other user-specific position to the first user-specific position.

15 Claims, 7 Drawing Sheets

HEADSET DEVICE WITH FITTING MEMORY

TECHNICAL FIELD

The invention relates to a headset device comprising an attachment device for attaching the headset device to the head of a user, an audio device for transducing audio to an electrical signal or vice versa, adjustment means for adjusting the mutual positions and/or orientations of the attachment device and the audio device to a user-specific position, in which the headset device is adjusted to the geometry of the users head.

BACKGROUND ART

Many headsets and headphones have adjustment possibilities so the users can adapt them to their head geometry. The term "head geometry" relates to the size of the head, the position of the mouth and ears etc. Often the term "head phones" is used for a pair of earphones, which are interconnected by a headband or neckband and used for audio listening, especially music listening. The tem headset is normally used for a device used for two-way communication and comprising a microphone and at least one earphone with an earphone speaker. In the following the term "headset device" is a term used for all devices comprising attachment means for attaching the device to the head of a user and at least one audio transducer, which may be an earphone or a microphone. Normally the headband used with headset devices is adjustable in length, so that they can be adapted to the user's specific head geometry. Headset devices for two-way communication devices are often embodied with an adjustable microphone arm, so that the microphone can be positioned in front of or close to the mouth of the user.

If the user is going to use the headset device after it has been taken off, put away and or used by another, it must be readjusted to fit the user. As it requires attention and time from the user to adjust the headset device correct, this is often not carried out in a satisfying way. Especially the adjustment of the microphone arm is problematic, as the user may not recognize that the microphone arm is misplaced, which results in poor audio for the person telecommunicating with the headset user.

Headsets with microphone arms are often embodied so that the microphone arm can be adjusted to a position, where microphone is positioned optimally in relation to the mouth.

JP 4170198 A2 discloses a headset device with an adjustable headband with indications showing the current adjustment of the headband.

Jabra Biz™ 2400 is a headset with an adjustable headband and a rotatable microphone arm. Tactile clicks follow a length adjustment of the headband and the rotational adjustment of the microphone arm.

DISCLOSURE OF INVENTION

The object of the invention is to improve the user-friendliness of a headset device of the type mentioned in the paragraph named "Technical Field". According to the invention, the adjustment means comprises selecting means for storing a first user-specific position, whereby a user quickly can readjust the headset device from a non-user-specific position or other user-specific position to the first user-specific position. Once, the user-specific position is stored, the user can easily and quickly adjust the headset device to the optimal position, whereby he can concentrate on using the headset device for communicating or audio listening without any annoying delays or mispositioned microphone or earphones.

According to an embodiment, the actual position can be stored as the first user-specific position, when the user activates the selecting means.

According to the invention, the audio device may be a microphone arm.

The microphone arm may comprise a microphone in the free end.

According to a preferred embodiment, the microphone arm is rotatable about a first axis in relation the attachment device.

The headset device may comprise a spring, which exerts a force on the microphone arm in the direction of the first user-specific position. Thus, if the microphone arm is temporarily mispositioned, the spring will force it back to the user-specific position.

The spring may be a torsion spring, which is located around the first axis.

The selecting means may comprise an adjustable stop member, which is rotatable about the first axis and which the microphone arm abuts in the first user-specific position.

According to another embodiment, the selecting means comprises a row of position sensors, which are provided to detect the rotational position of the microphone arm.

These sensors may be optical or inductive. Thus, optical receivers may be used to detect whether a the microphone arm is in a view and provides shade for incoming light, or alternatively reflects light from an optical transmitter provided adjacent each optical receiver. Inductive sensors may sense metallic content of the microphone arm.

The position sensors may be arranged along a circular arc.

According to a preferred embodiment, the position sensors are connected to an electronic circuit, which is adapted to provide an audible and/or optical output in dependence of whether the microphone arm is in the first user-specific position or not.

Thus, an audible tone may be played, when the user-specific position is obtained. Alternatively, a sound may change in dependence of the distance from the user-specific position. Alternatively, a voice may guide the user by for example saying: "turn clockwise", "turn counter clockwise", "stop", "correct position" or the like.

The headset device may comprise a memory switch connected to the electronic circuit, whereby the actual position of the microphone arm is stored as the first user-specific position, when the switch is actuated. Thus, the user may for example stand in front of a mirror and actuate the switch when he recognizes that the microphone is adjusted to the optimal position.

According to an embodiment, the headset device comprises a first earphone, wherein the attachment device comprises a headband, which is slidably connected to the headband.

The headset device may comprise a number of headband position sensors, which are provided to detect the length adjustment of the headband.

The headband sensors may be optical or inductive sensors.

According to an embodiment, the headband comprises a headband housing with a channel receiving the headband.

The headset device according to the invention may comprise at least one earphone comprising an earphone speaker.

Preferably, the microphone arm is movably attached to the earphone.

Preferably, the attachment device is movably attached to the earphone.

BRIEF DESCRIPTION OF THE DRAWINGS

The invention is explained in detail below with reference to the drawing illustrating preferred embodiments of the invention and in which.

MODES FOR CARRYING OUT THE INVENTION

Figure 1:
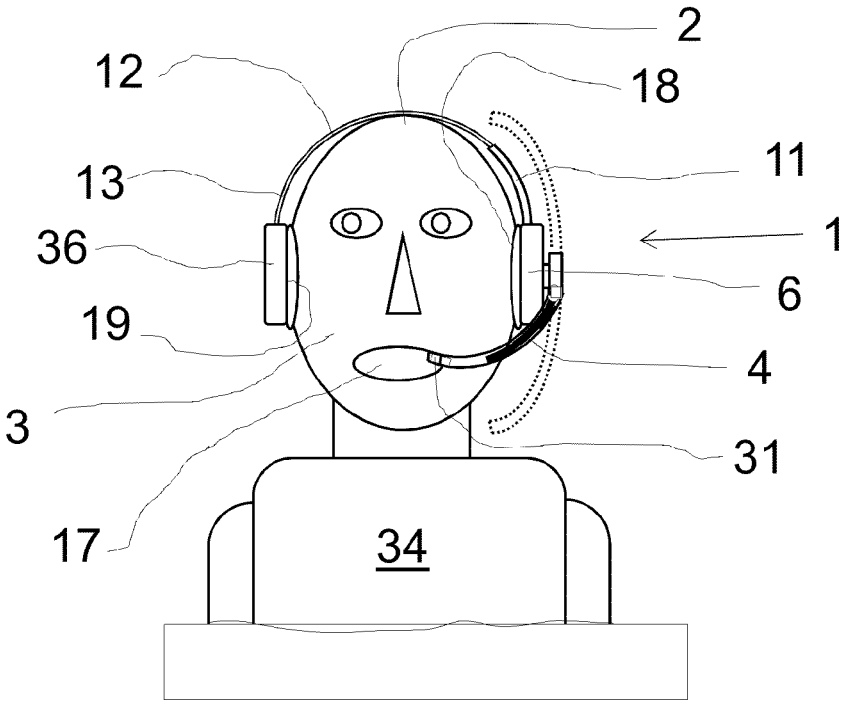
FIG. 1 is a front view of a first embodiment of a headset device according to the invention in a use position.

FIG. 1 is a front view of a user 34 wearing on his head 3 a first embodiment of a headset device 1 according to the invention. The headset device 1 comprises a first earphone 6, a second earphone 36, a headband 12 interconnecting the two earphones 6, 36 and a microphone arm 4 extending from the first earphone 6 with a microphone 31 at its free end. The first earphone 6 is located on the user's left ear 18 and the second earphone 36 is located on the user's right ear 19. Each earphone 6, 36 comprises an earphone speaker providing audio to each of the user's ears 18, 19. The headband 12 is slidably received in a headband housing 11, which is fixedly connected to the first earphone 6. In this way, the headband can be adjusted to the size of the users head 3 and the position of the ears 18, 19. The microphone arm 4 is rotatably attached to the first earphone 6, whereby it can be rotated into a position where the microphone 31 is optimally positioned in relation to the mouth 17. In FIG. 1, the optimal position of the microphone arm 4 is shown with solid lines, wherein two other positions are shown with dashed lines.

Figure 2:
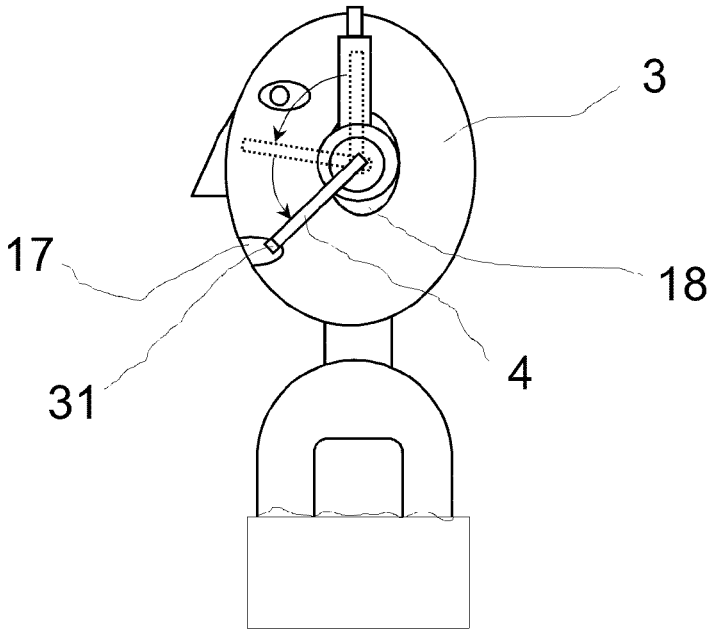
FIG. 2 is a side view of what is disclosed in FIG. 1.

FIG. 2 is a side view of what is disclosed in FIG. 1. As shown, the microphone arm 4 is rotated from an upwards pointing direction to a user-specific position, where the microphone arm 4 is pointing in the direction of the mouth 17. In this position, the microphone 31 is placed as close as possible to the mouth, whereby an optimal signal-to-noise ratio can be obtained. The head geometry varies between users, which means that the size of the head, the position of the ears and the mouth vary. The rotational position of the microphone arm 4 is optimal for the shown user 34. However, another rotational position of the microphone arm 4 may be optimal for another user with a different head geometry.

Figure 3:
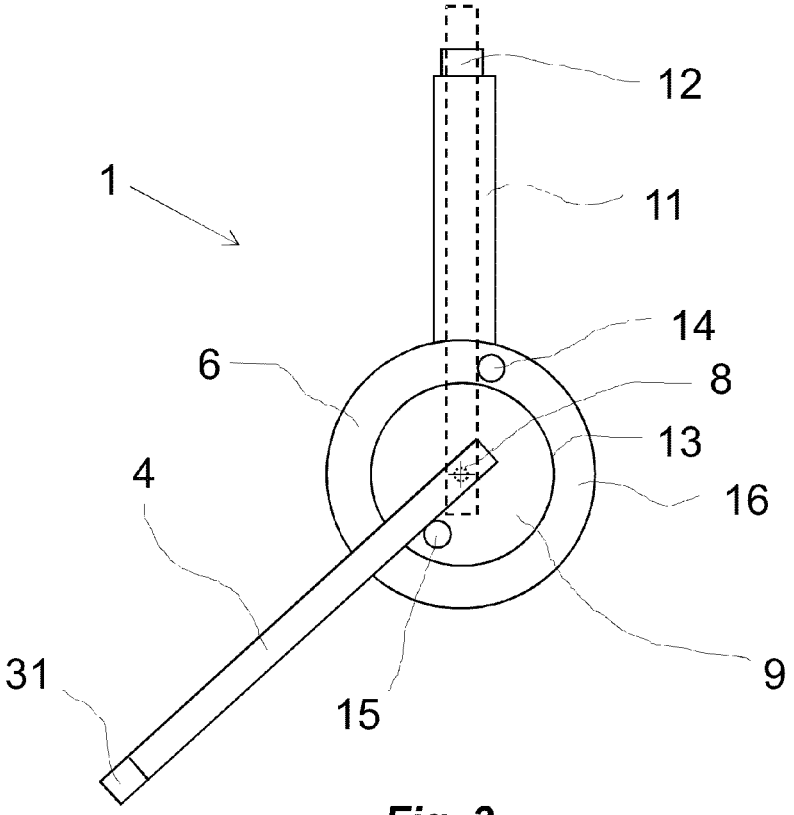
FIG. 3 is a more detailed side view of the first embodiment of a headset device.
Figure 4:
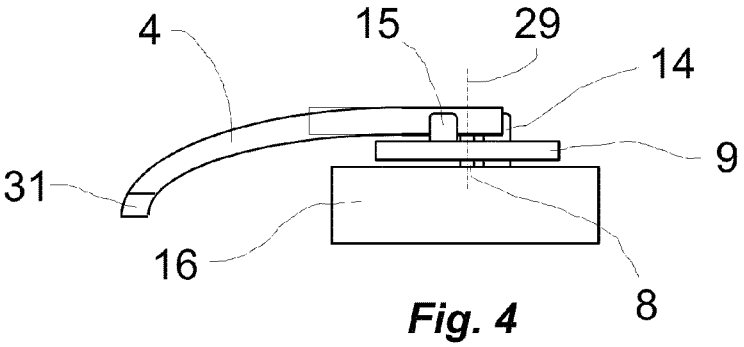
FIG. 4 is a bottom view of the first embodiment.

FIG. 3 is a more detailed side view and FIG. 4 is a more detailed bottom view of the first embodiment of the headset device 1. The first earphone 6 comprises an earphone housing 16, a pivot 8 and a memory disc 9. The pivot 8 extends vertically along a first axis 29 from the side of the earphone housing 16, facing away from the user's ear. The microphone arm 4 and the memory disc 9 are both pivotally journalled on the pivot 8. However, the memory disc 9 is journalled with more friction than the microphone arm 4 so that it requires much more force to rotate than the microphone arm 4. A use position cam 15 extends from the outer side of the memory disc 9 and defines the user-specific position of the microphone arm 4. In the optimal use position, the microphone arm 4 abuts the use position cam 15 as shown in FIG. 3. Thus, the user may rotate the memory disc clockwise and counter clockwise, until the desired position is obtained. If the microphone arm 4 is rotated clockwise to a rest position shown with dashed lines in FIG. 3, the user can quickly rotate it back to the user-specific position by rotating it until it hits the use position cam 15 and a large resistance against further rotation in counter clockwise direction can be felt. The user may wish to rotate the microphone arm 4 to the rest position, when he is not in a call or wants to take the headset off his head. A rest stop cam 14 protrudes from the outer side of the headset housing 16 outside the periphery 13 of the memory disc 9, which has smaller diameter than the earphone housing 16. The rest stop cam 14 helps the user finding the rest position, as this will be obtained, when the microphone arm 4 abuts the rest stop cam 14.

Figure 5:
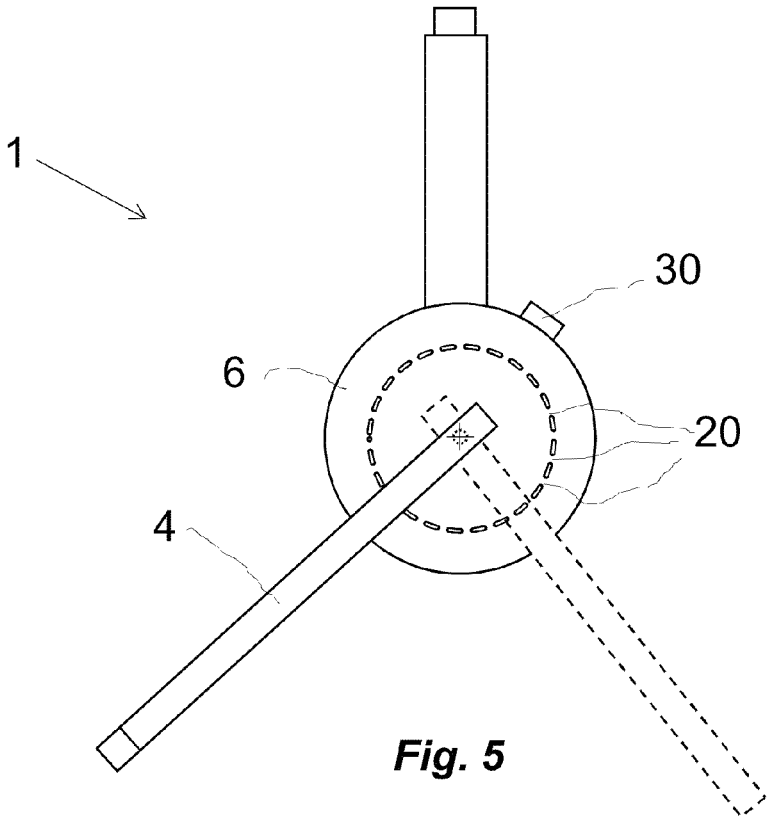
FIG. 5 is a side view of a second embodiment of a headset device.
Figure 6:
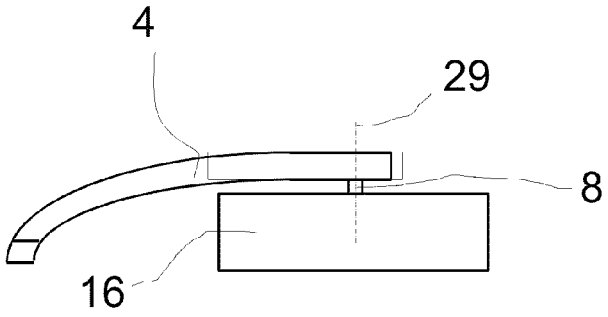
FIG. 6 is a bottom view of the second headset device.

FIG. 5 is a side view and FIG. 6 is a bottom view of a second embodiment of a headset device 1 according to the invention. While the first embodiment was a pure mechanical solution, this is an electronic solution. Like the first embodiment, the microphone arm 4 is pivotally journalled on a pivot 8 extending along a first axis 29. A circular row of optical sensors 20 are located around the first axis. The position of the microphone arm 4 is sensed by the optical sensors 20 located immediately below the microphone arm 4. In the shown embodiment, the microphone arm 4 can rotate 360 degrees. A memory switch 30 embodied as a push-button can be actuated by the user, when the microphone arm 4 is in the optimal position, whereby the electronics, which are connected to the sensors 20 detect the position. If the user moves the microphone arm 4 away from the optimal use position, the electronics may give an audible indication in the earphone 6. In addition, an audible tone may be played, when the user-specific position is obtained. Alternatively, a sound may change in dependence of the distance from the user-specific position. Or, a voice may guide the user by for example saying: "turn clockwise", "turn counter clockwise", "stop", "correct position" or the like. The headset may also be motorized, whereby a short actuation of the memory switch may start a motor driven rotation of the microphone arm 4 to the user-specific position. In a preferred embodiment, a short press on the memory switch 30 may start movement of the microphone arm 4 to the stored position, while a long press will store the current position as the user-specific position. The sensors 20 may be encapsulated in the earphone housing 16 to protect them against dust or "false light". FIG. 5 indicates a use scenario, where the first earphone 6 is placed on the left ear. However, if the user wants to have the microphone arm 4 on the right side of his head, he may place the first earphone 6 on the right ear. In this situation, another user-specific position should be stored. However, the electronics could be intelligent and guess whether the first earphone 6 is located on the left or right ear. Thus, if the microphone arm 4 points in the left direction when looked at as in FIG. 5, the first earphone 6 is probably located on the left ear. If the microphone arm 4 points to the right as indicated with the dashed lines, the first earphone 6 is probably located on the right ear. A first user-specific position may be stored for left ear use, and a second user-specific position may be stored for right ear use. Other mechanisms to identify left or right ear position of the first earphone could be contemplated.

Figure 7:
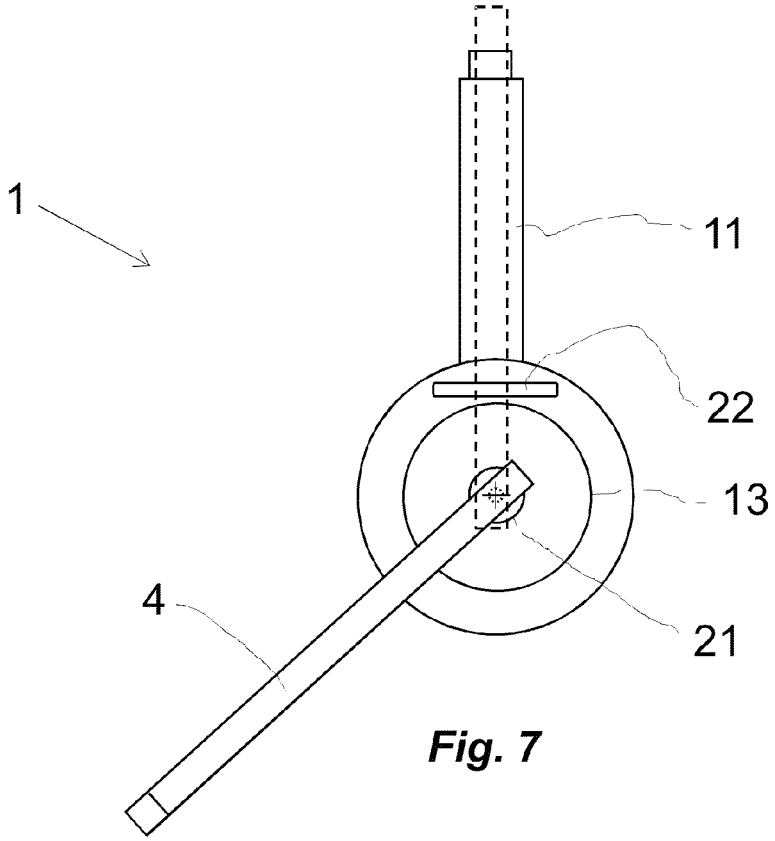
FIG. 7 is a side view of a third embodiment of a headset device.
Figure 8:
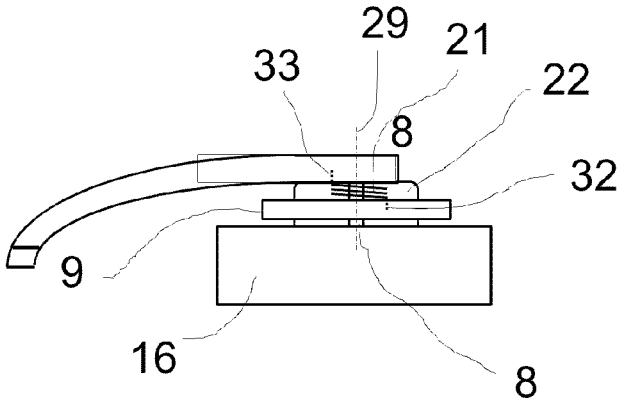
FIG. 8 is a bottom view of the third embodiment.

FIG. 7 is a side view and FIG. 8 is a bottom view of a third embodiment of a headset device 1 according to the invention. Just like first earphone of the first embodiment, the first earphone 6 of the third embodiment comprises a pivot 8, about which a microphone arm 4 and a memory disc 9 rotate. The memory disc 9 requires much more force to rotate than the microphone arm 4. A torsion spring 21 is located around the pivot 8 between the memory disc 9 and the microphone arm 4. A first spring end 32 is attached to the memory disc 9 and a second spring end 33 is attached to the microphone arm 4. The spring force exerted by the spring 21 is stronger than the friction force between the microphone arm 4 and the pivot. Thus, the spring 21 will force the microphone arm to the equilibrium point of the spring 21. In the user-specific position of the microphone arm 4 shown in FIGS. 7 and 8 the spring 21 exerts no force on the microphone arm 4. However, if the user moves to microphone arm 4 away from this position, the spring 21 will force it back immediately after the user let go off the microphone arm 4. If the user-specific position is to be adjusted, the user simply turns the memory disc 9 about the first axis 29 to the position where the microphone arm 4 is optimally positioned. A rest position cam 22 protrudes from earphone housing 16 outside the periphery 13 of the memory disc 9 and close to the headband 2. When the microphone arm 4 is moved to a rest position, shown with dashed lines, where it is more or less parallel with the headband housing 11, it will deflect slightly and slide on the rest position cam 22. The friction between surface of the microphone arm 4 and the top surface of the rest position cam 22 is greater than the spring force, whereby the microphone arm 4 will be retained at the rest position until the user pushes it free from the rest position cam 22.

Figure 9:
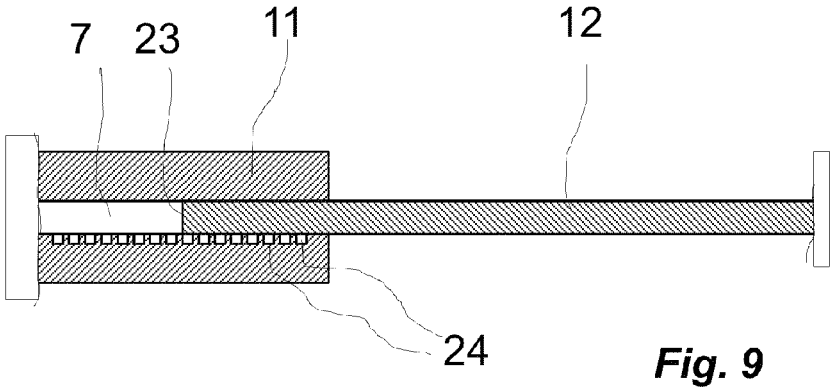
FIG. 9 is a cross-sectional view through a headband of a fourth embodiment of a headset device.

FIG. 9 is a cross-sectional view through a headband of a fourth embodiment of a headset device according to the invention. The view only discloses the portion of the headband, where the adjustment of the headband length takes place. An end of the headband 12 is slidably received in a channel 7 in the headband housing 11. By pushing the headband 12 further into to the channel 7, the "usable part" of the headband 12 is shortened, and by pulling the headband 12 more out of the channel 7, the headband is lengthened. The headband housing and headband are held together by friction. A not shown stop member prevents the headband 12 from being removed completely from the headband housing. Electrical wiring in the headband and the headband housing are left out for clarity reasons. A row of inductive sensors 24 are provided in the wall of the channel 7. They detect the position of the end face 23 of the headband, which is made of metal. When the headband 12 is adjusted in length to a specific user, he may push a not shown button, whereby the electronics connected to the inductive sensors 24 stores the position. If the user shortens the headband for transporting or lend the headset to another user and later on wants to readjust it, the electronics may advise him by providing an audible alert, when the correct length is obtained.

Figure 10:
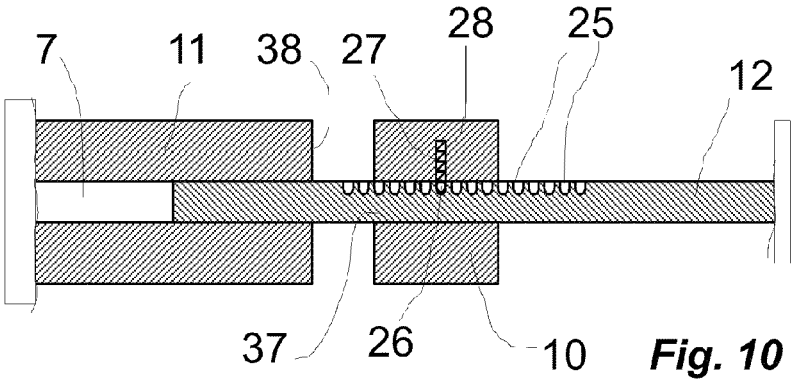
FIG. 10 is a cross-sectional view through a headband of a fifth embodiment of a headset device.

FIG. 10 is a cross-sectional view through a headband of a fifth embodiment of a headset device according to the invention. While the fourth embodiment was an electronic solution, the fifth embodiment is a pure mechanical solution. Also here, the headband 12 is slidably received in a channel 7 in the headband housing 11. The headband 12 is provided with a row of positioning indentations 25 in the surface. The headband 12 is guided through a passage 37 in a memory block 10. In the wall of the passage 37 there is provided a blind hole 28 with a compression spring 27 acting on a locking ball 26. The locking ball 26 engages with one of the positioning indentations 25 and locks the memory block 10 in this position. Thus, the memory block 10 functions as a stop block for the end face 38 of the headband housing 11. For example, the user may lengthen the headband for another user with a larger head or if folding of the headset requires so, and when he wants to return to the user-specific position, he simply shortens the headband, until the end face 38 of the headband housing 11 abuts the memory block 10. If another user-specific position is desired, a relatively high force may be exerted on the memory block 10 in order to slide it to a position where the locking ball 26 engages another positioning indentation 25.

Figure 11:
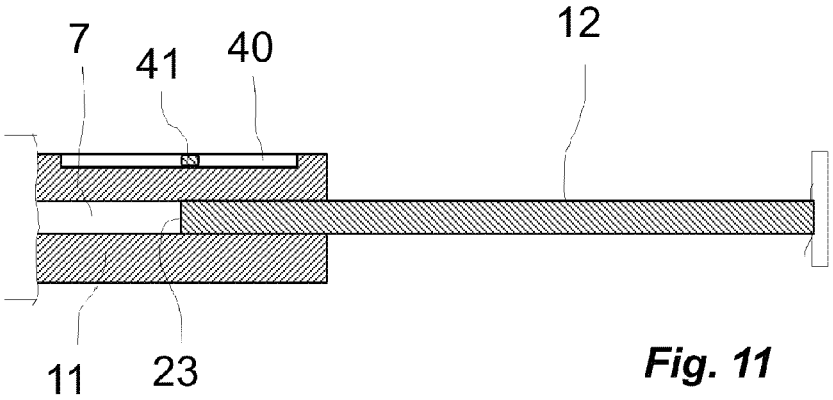
FIG. 11 is a cross-sectional view through a headband of a sixth embodiment of a headset device.

FIG. 11 is a cross-sectional view through a headband of a sixth embodiment of a headset device according to the invention. This solution is pure mechanical. The headband 12 is slidably received in a channel 7 in the headband housing 11. The headband housing 11 is made of transparent material and is provided with a longitudinal indicator groove 40 with an indicator block 41 slidably received in the indicator groove 40. When the headband 12 has been adjusted to the user's head, the user may align the indicator block 41 with the end face 23 of the headband 12. If the user later on, after the headset device has been lend to another user with a different head geometry, wants to readjust it to the stored position, he simply aligns the end face 39 with the indicator block 41.

Figure 12:
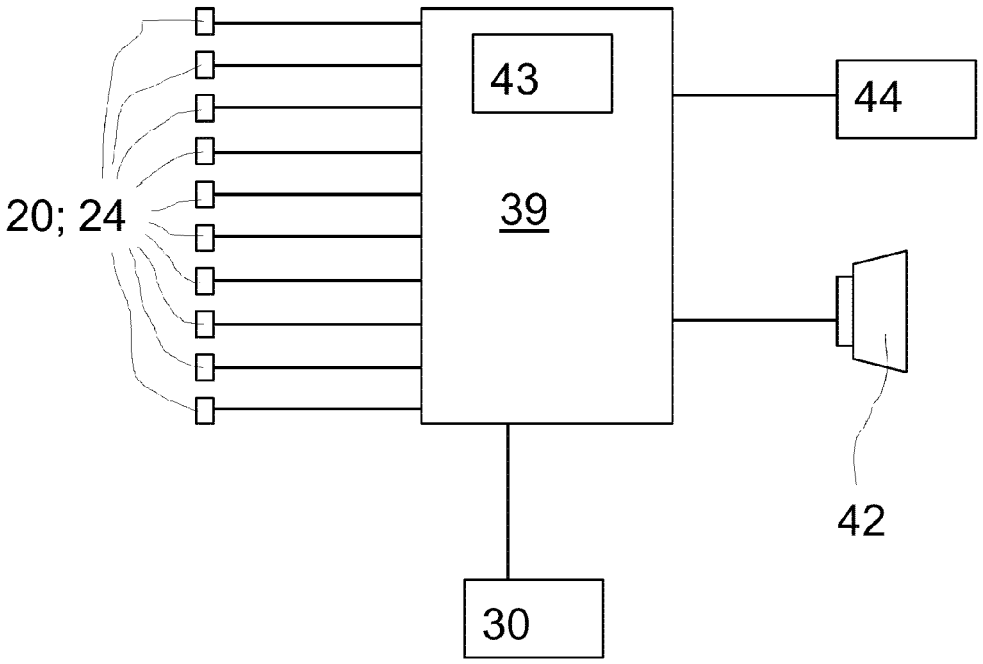
FIG. 12 is a diagram showing the overall electronic system of the second and fourth embodiments.

FIG. 12 is a diagram showing the overall electronic system of the second and fourth embodiments. The rotational position sensors 20 of the second embodiment shown in FIG. 5 and/or the headband position sensors 24 of the fourth embodiment shown in FIG. 9 are connected to an electronic circuit 39. This electronic circuit 39 is able to store the current position of the microphone arm 4 and/or the length adjustment of the headband 2 in a memory circuit 43, when a user activates the memory switch 30. When the user later on adjusts the microphone arm 4 and or headband length, the electronic circuit may generate an alert, such as an audible alert sent to a speaker 42 or on optical alert emitted by a light emitting diode 44. The speaker 42 may be the earphone speaker 42 which is used for audio playback or communication.

Figure 13:
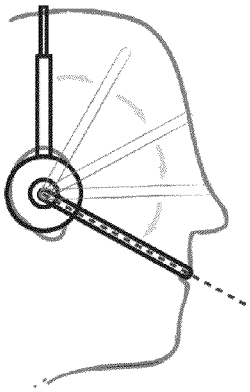
FIGS. 13-17 are user scenarios, where a user adjusts different embodiments of a headset device according to the invention.
Figure 14:
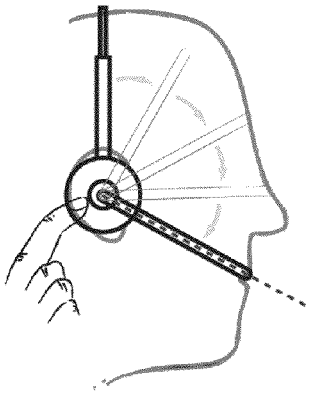
Figure 15:
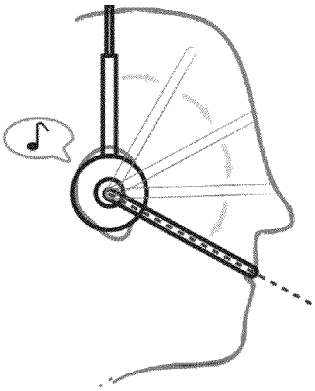
Figure 16:
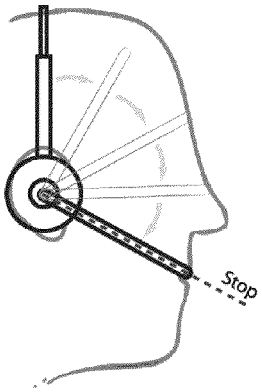
Figure 17:
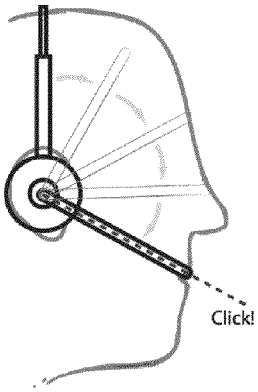

FIGS. 13-17 disclose different user scenarios, where a user adjust a headset device according to the invention. FIG. 13 discloses a headset on a head of a user, where the microphone arm moves automatically into the stored position, when the user put the headset on his head. This movement can be caused by a spring force or an electromotor. FIG. 14 discloses a situation, where the microphone arm moves into the stored position, when the user activates a button on the headset. FIG. 15 discloses a scenario, where the earphone speaker provides an audible feedback, when the microphone arm reaches the stored position. The movement can be carried out manually by the user's hand. FIG. 16 discloses a scenario, where a mechanically stored position prevents the microphone arm from moving beyond the stored position. FIG. 17 discloses a scenario, where a mechanically stored position provides a tactile click, when the microphone arm reaches the stored position.

In the description above, the attachment device is a headband. However, the attachment device could be any other device that is used to attach the headset device to the head of a user, such as a neckband, an ear hook, an ear loop or even an ear bud.

In an alternative embodiment, the position of microphone arm 4 may be detected by means of a binary code disc.

The headset device according to the invention could also be adapted to store more than one user-specific position, whereby optimal positions for two or more different users can be saved for the same headset device.

The invention relates to corded and wireless headset devices. Parts relating to the normal functionality of the headset device, such as cords, wireless transceivers, antennas, rechargeable batteries, digital signal processing circuits et cetera are left out from this description for clarity reasons.

The invention relates to headset devices with 2, 1 and even 0 earphones. A headset device with two earphones is normally called a duo headset or stereo headset. A headset device with one earphone is normally called a mono headset or monaural headset. A headset with no earphones could be a head worn microphone device.

Switching functionality relating to the position of the microphone arm and or length adjustment of the headband may be combined with the invention. Thus, the headset device may be adapted to switch electronics off or mute the microphone when the microphone arm 4 is in the rest position. Alternatively, the headset device electronics may be switched off or the microphone be muted, if the microphone arm 4 is not in the user-specific position.

| Reference signs: | |
|---|---|
| 1 | headset device |
| 2 | top of head |
| 3 | head |
| 4 | microphone arm |
| 5 | microphone |
| 6 | first earphone |
| 7 | headband channel |
| 8 | microphone arm pivot |
| 9 | memory disc |
| 10 | memory block |
| 11 | headband housing |
| 12 | headband |
| 13 | periphery of memory disc |
| 14 | rest stop cam |
| 15 | use position cam |
| 16 | ear phone housing |
| 17 | mouth |
| 18 | left ear |
| 19 | right ear |
| 20 | rotational position sensors |
| 21 | spring |
| 22 | rest position cam |
| 23 | end of second headband part 12 |
| 24 | headband position sensors |
| 25 | positioning indentations |
| 26 | locking ball |
| 27 | compression spring |
| 28 | blind hole |
| 29 | first axis |
| 30 | memory switch |
| 31 | microphone |
| 32 | first spring end |
| 33 | second spring end |
| 34 | user |
| 36 | second earphone |
| 37 | passage in memory block |
| 38 | end face of first headband part |
| 39 | electronic circuit |
| 40 | indicator groove |
| 41 | indicator block |
| 42 | speaker |
| 43 | memory circuit |
| 44 | light emitting diode |

The invention claimed is:

1. A headset device comprising an attachment device for attaching the headset device to the head of a user, an audio device, including a microphone boom and a pivot axis, said boom being rotatable on said axis, for transducing audio to an electrical signal or vice versa, an adjuster capable of adjusting the mutual positions and/or orientations of the audio device to a user-specific position, wherein the adjuster comprises a selector capable of storing a first user-specific angular position of said microphone boom, whereby a user quickly can readjust the headset device from a non-user-specific position to the first user-specific position whereby the actual position is stored as the first user-specific position, when the user activates the selector.

2. A headset device according to claim 1, wherein the selector includes increased mechanical resistance to rotation of said boom when said boom is proximate the angular position of said first user-specified position.

3. A headset device according to claim 2, wherein the-selector includes audible feedback to the user when said boom reaches the angular position of said first user-specified position.

4. A headset device according to claim 3, wherein the selector includes a mechanical bias element to urge the boom back to said the angular position of said first user-specified position.

5. Headset device according to claim 4, wherein the selector includes parking element which engages said boom when the boom is in an angular position generally aligned with the attachment device, thereby defining a parked position, and wherein said parking element is configured to overcome force of said bias element when the boom is so aligned, so that the boom will not revert to said first user-specific position when so aligned.

6. A headset device according to claim 3, wherein the selector further includes an adjustable stop member, which is rotatable about the first axis and which the boom abuts in the first user-specific position.

7. A headset device according to claim 3, wherein the selector includes a plurality of angularly spaced position sensors and a circuit connected to said sensor to detect the rotational position of the microphone boom.

8. A headset device according to claim 7, wherein the position sensors are arranged along a circular arc.

9. A headset device according to claim 7, wherein the circuit is adapted to provide an audible output in dependence of whether the microphone boom is proximate the first user-specific position.

10. A headset device according to claim 7, wherein the circuit is adapted to provide an optical output in dependence of whether the microphone boom is proximate the first user-specific position or not.

11. A headset device comprising an attachment device for attaching the headset device to the head of a user, an audio device for transducing audio to an electrical signal or vice versa, adjuster permitting adjustment of the mutual orientations of the attachment device and the audio device to a user-specific position, in which the headset device is adjusted to the geometry of the users head, wherein the adjuster comprises a selector capable of storing a first user-specific position, whereby a user quickly can readjust the headset device from a non-user-specific position or other user-specific position to the first user-specific position;

wherein the audio device is rotatable about a first axis in relation the adjuster; and wherein the selector comprises a row of position sensors, which are connected to an electronic circuit and are provided to detect the rotational position of the audio device and further including a memory switch connected to the electronic circuit, wherein the actual position of the microphone arm is stored as the first user-specific position, when the switch is actuated.

12. A headset device according to claim 1 comprising a first earphone and wherein the attachment device comprises a headband, which is slidably connected to the earphone.

13. A headset device according to claim 3, wherein the audible feedback includes audible guidance to advise the user of the needed direction of rotation to reach the user specified position.

14. A headset device according to claim 1, further including a motor to drive the boom mic to the user-specified position.

15. The headset of claim 1 further including a circuit for determining if the boom is oriented for right or left hand usage.

* * * * *